US009816243B2

(12) United States Patent
Perry et al.

(10) Patent No.: US 9,816,243 B2
(45) Date of Patent: Nov. 14, 2017

(54) ARCTIC JACKUP TRUSS LEG

(71) Applicant: Keppel Offshore & Marine Technology Centre Pte Ltd, Singapore (SG)

(72) Inventors: Michael John Perry, Singapore (SG); Kok Seng Foo, Singapore (SG); Matthew Chin Kau Quah, Singapore (SG)

(73) Assignee: Keppel Offshore & Marine Technology Centre Pte Ltd, Singapore (SG)

( * ) Notice: Subject to any disclaimer, the term of this patent is extended or adjusted under 35 U.S.C. 154(b) by 0 days.

(21) Appl. No.: 14/702,748

(22) Filed: May 3, 2015

(65) Prior Publication Data

US 2015/0315761 A1 Nov. 5, 2015

Related U.S. Application Data

(60) Provisional application No. 61/988,316, filed on May 5, 2014.

(51) Int. Cl.

| | |
|---|---|
| ***E02B 17/00*** | (2006.01) |
| ***E02B 17/02*** | (2006.01) |
| *E02B 17/08* | (2006.01) |

(52) U.S. Cl.

CPC ..... *E02B 17/021* (2013.01); *E02B 17/00* (2013.01); *E02B 17/0004* (2013.01); *E02B 17/0021* (2013.01); *E02B 17/02* (2013.01); *E02B 17/0818* (2013.01); *E02B 2017/006* (2013.01); *E02B 2017/0056* (2013.01); *E02B 2017/0082* (2013.01)

(58) Field of Classification Search

CPC .... E02B 17/02; E02B 17/021; E02B 17/0818; E02B 2017/006

See application file for complete search history.

(56) References Cited

U.S. PATENT DOCUMENTS

| | | | | |
|---|---|---|---|---|
| 4,648,751 | A * | 3/1987 | Coleman | E02B 17/02 114/46 |
| 4,657,437 | A * | 4/1987 | Breeden | E02B 17/021 405/196 |
| 5,797,703 | A * | 8/1998 | Delamatyr | E02B 17/0818 114/265 |
| 7,594,781 | B1 | 9/2009 | Sanders | |

(Continued)

FOREIGN PATENT DOCUMENTS

| | | |
|---|---|---|
| JP | 62-185726 U | 11/1987 |

OTHER PUBLICATIONS

International Search Report and Written Opinion of International Application No. PCT/SG2015/050094 completed and dated Jun. 5, 2015 (9 pages).

*Primary Examiner* — Matthew R Buck
*Assistant Examiner* — Aaron L Lembo
(74) *Attorney, Agent, or Firm* — Pyprus Pte Ltd

(57) ABSTRACT

An arctic jackup truss leg comprises a plurality of chords, an outer bracing network with a plurality of bracing elements connecting the plurality of chords, an internal bracing network with a plurality of bracing elements, and a bridge plate network with a plurality of bridge plates, wherein each bridge plate has two ends that are coupled with the bracing elements of the outer bracing network and the internal bracing network respectively.

4 Claims, 7 Drawing Sheets

(56) References Cited

U.S. PATENT DOCUMENTS

| | | | | |
|---|---|---|---|---|
| 2010/0040418 | A1 | 2/2010 | Wishahy et al. | |
| 2010/0288178 | A1* | 11/2010 | Mansour | B63B 39/00 114/265 |
| 2011/0100280 | A1* | 5/2011 | Leverette | B63B 35/44 114/122 |
| 2014/0086690 | A1 | 3/2014 | Foo et al. | |

* cited by examiner

ARCTIC JACKUP TRUSS LEG

RELATED APPLICATION

This application claims the benefit under 35 U.S.C. 119(e) of U.S. Provisional Application Ser. No. 61/988,316 entitled "Arctic Jackup Truss Leg", filed May 5, 2014, which is herein incorporated by reference.

FIELD OF THE INVENTION

The present invention relates generally to jackup rigs, and more particularly to an arctic jackup truss leg being suitable to be employed in a jackup rig.

BACKGROUND OF THE INVENTION

A jackup rig is an offshore oil and gas exploration drilling structure or a work-over platform being used in shallow water, typically in water with depths up to 500 feet. The jackup rig usually comprises a floatable hull with a deck or working platform, and three or four legs, where the legs provide support for the floatable hull when the floatable hull is in elevated conditions. After the jackup rig arriving on location, the legs are lowered until they touch the underneath seabed and rest on the soil on the seabed; then the hull may be jacked up using a jacking system to raise the working platform above the water, making the jackup rig safe to be operated in open water situations where water movement is experienced.

The legs of a jackup rig are commonly tubular columns or trusses. One truss leg comprises vertical chords connected with cross braces that are normally diagonally disposed. When located in an arctic area, the leg needs to be able to accommodate large horizontal loads from incoming ice. An enclosed jackup leg such as a tubular column can achieve high strength, but its large, enclosed profile causes large loads from waves that can occur in summer when ice is not present. A traditional jackup truss leg is transparent to waves and so can withstand large waves by avoiding large forces; but the slender braces connecting the main chords are not designed to carry concentrated horizontal loads from sea ice and have limited capacity of withstanding these forces.

SUMMARY OF THE INVENTION

One aspect of the present invention provides a truss leg employable in a jackup platform. In one embodiment, the truss leg comprises a plurality of chords, an outer bracing network with a plurality of bracing elements connecting the plurality of chords, an internal bracing network with a plurality of bracing elements, and a bridge plate network with a plurality of bridge plates, wherein each bridge plate has two ends that are coupled with the bracing elements of the outer bracing network and the internal bracing network respectively, thereby the outer bracing network, the bridge plate network, and the internal bracing network act together as an integrated member. In another embodiment, the truss leg further comprises a plurality of stiffeners, wherein the plurality of stiffeners are applied to the bridge plates.

Another aspect of the present invention provides a jackup platform. In one embodiment, the jackup platform comprises a platform, a plurality of arctic jackup truss legs, and platform accessories, wherein each of the plurality of the arctic jackup truss legs comprises a plurality of chords, an outer bracing network with a plurality of bracing elements connecting the plurality of chords, an internal bracing network with a plurality of bracing elements, and a bridge plate network with a plurality of bridge plates, wherein each bridge plate has two ends that are coupled with the bracing elements of the outer bracing network and the internal bracing network respectively, thereby the outer bracing network, the bridge plate network, and the internal bracing network act together as an integrated member. In another embodiment, the arctic jackup truss leg further comprises a plurality of stiffeners, wherein the plurality of stiffeners are applied to the bridge plates.

The objectives and advantages of the invention will become apparent from the following detailed description of preferred embodiments thereof in connection with the accompanying drawings.

BRIEF DESCRIPTION OF THE DRAWINGS

Preferred embodiments according to the present invention will now be described with reference to the Figures, in which like reference numerals denote like elements.

DETAILED DESCRIPTION OF THE INVENTION

The present invention may be understood more readily by reference to the following detailed description of certain embodiments of the invention.

Throughout this application, where publications are referenced, the disclosures of these publications are hereby incorporated by reference, in their entireties, into this application in order to more fully describe the state of art to which this invention pertains.

The present invention provides an arctic jackup truss leg that achieves high strength against horizontal ice loads and at the same time reduces wave loads on the leg so as to retain its feature of being "transparent" to waves. Briefly, the arctic jackup truss leg comprises a plurality of chords, an outer bracing network with a plurality of outer bracing elements connecting the plurality of chords, an internal bracing network with a plurality of internal bracing elements, and a bridge plate network with a plurality of bridge plates, where each bridge plate has two opposite ends, one end being coupled with the outer bracing network and the other end with the internal bracing network. The outer bracing network, the bridge plate network, and the internal bracing network collectively act together as a strong integrated structure, resulting in a strong I-beam-type resistance to large horizontal ice loads. Furthermore, the bridge plate network and internal bracing network can be assembled into the outer bracing network as additional components; thus, the present invention is also suitable for retrofitting existing truss legs in a jackup rig.

Figure 1:
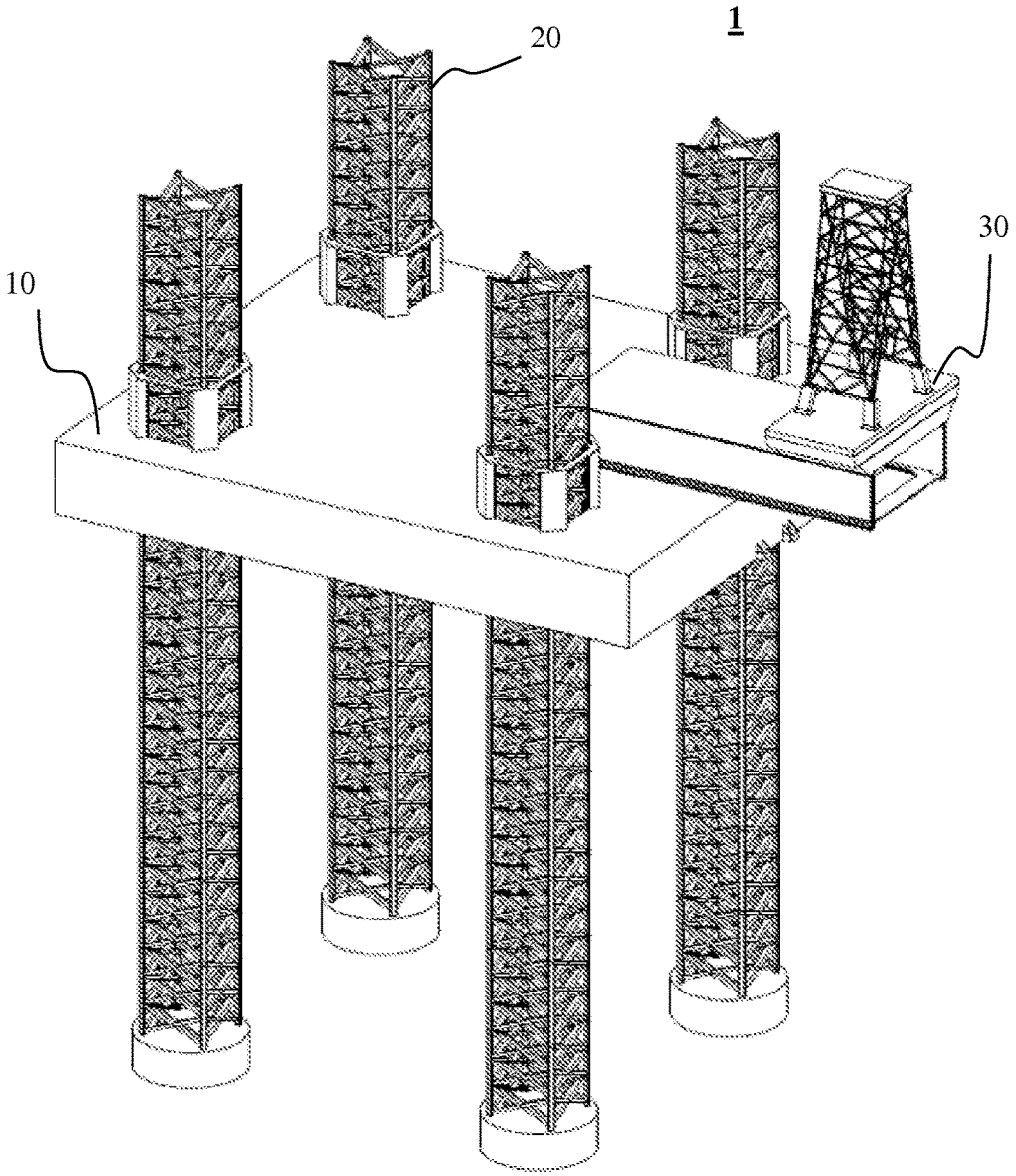
FIG. 1 shows an isometric schematic view of a jackup rig comprising four arctic jackup truss legs in accordance with one embodiment of the present invention.
Figure 2:
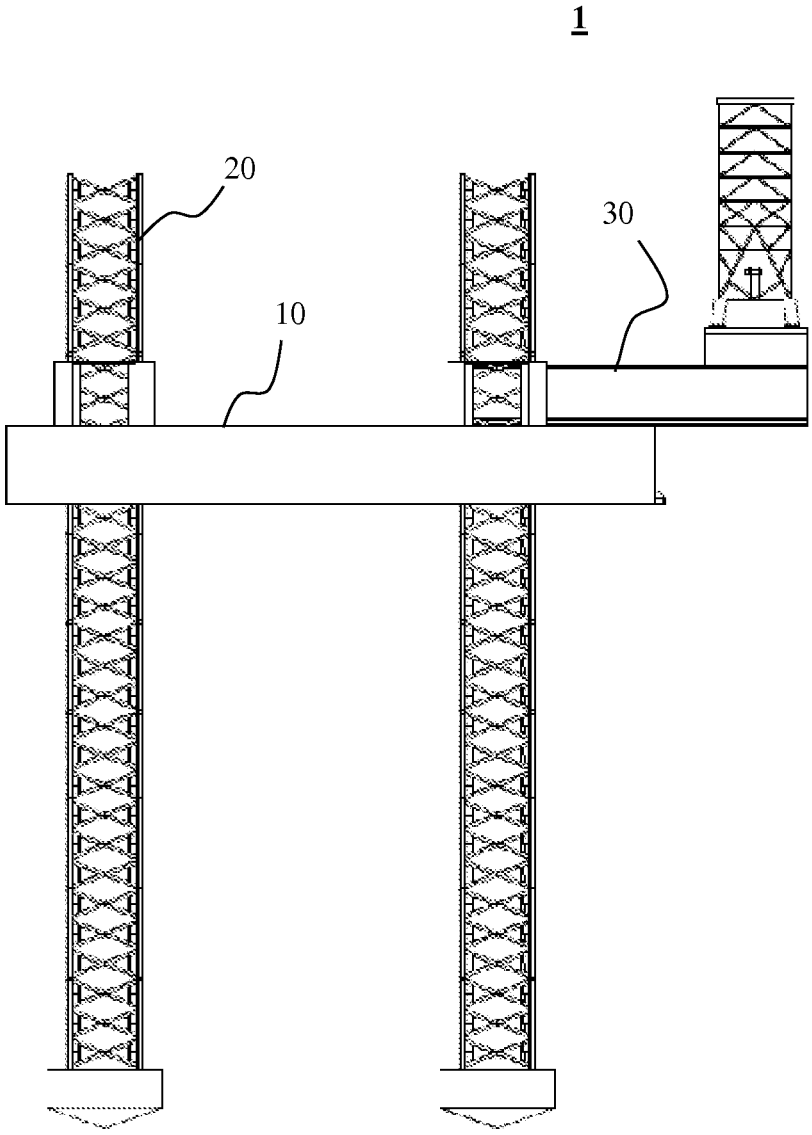
FIG. 2 shows a side view of the jackup rig shown in FIG. 1.

Referring now to FIGS. 1 and 2, there are provided isometric schematic and side views of a jackup rig employing four arctic jackup truss legs in accordance with one embodiment of the present invention. The jackup rig 1 comprises a platform 10, a plurality of legs (4 shown herein) 20, and platform accessories 30 (for example, a drilling package as shown). It is to be noted that a jackup rig could have three legs.

Figure 3:
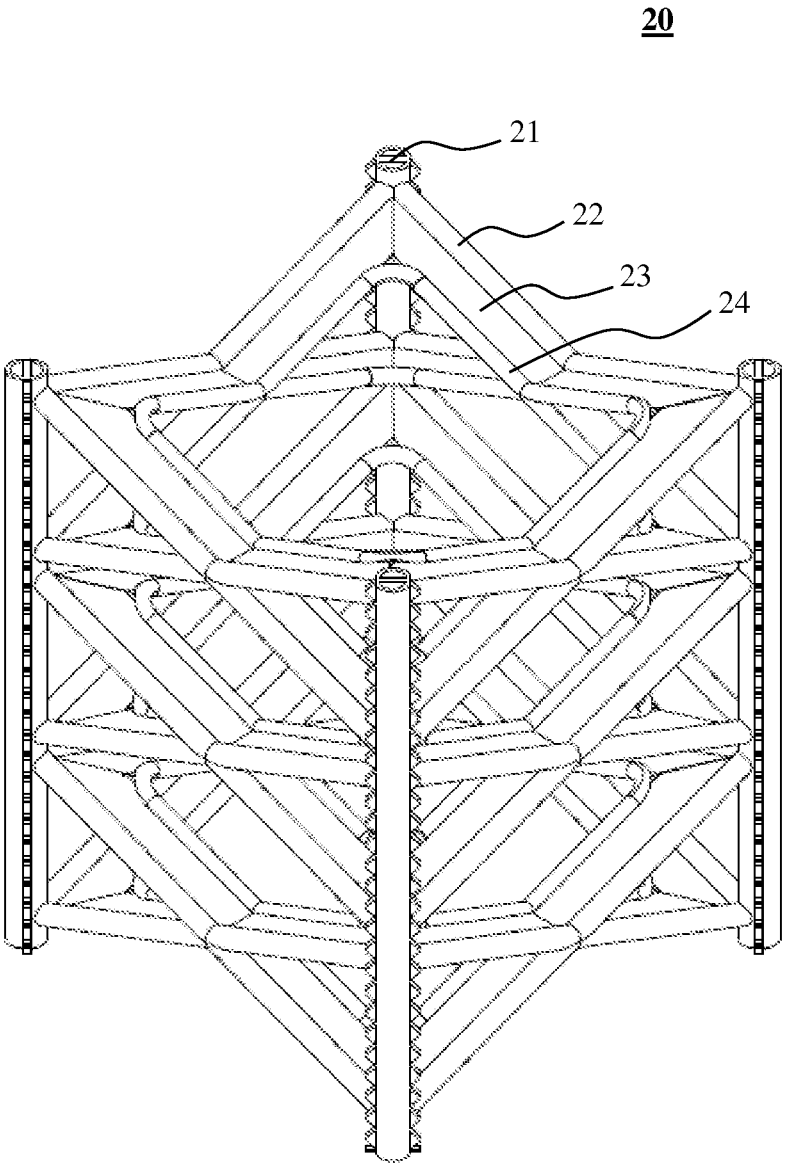
FIG. 3 shows an isometric plan view of a portion of the arctic jackup truss leg in accordance with one embodiment of the present invention.
Figure 4:
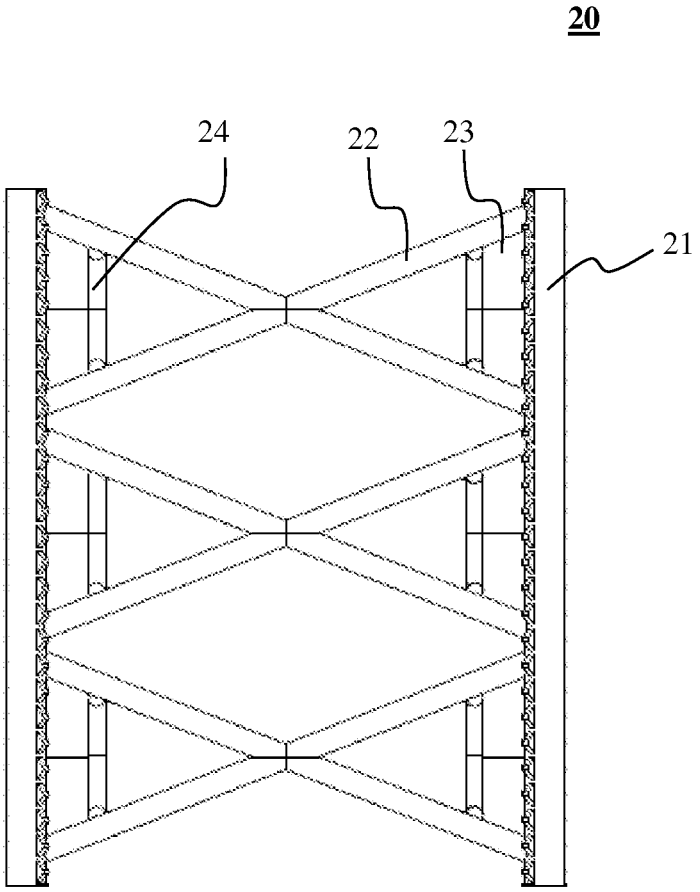
FIG. 4 shows a side view of a portion of the arctic jackup truss leg shown in FIG. 3.
Figure 5:
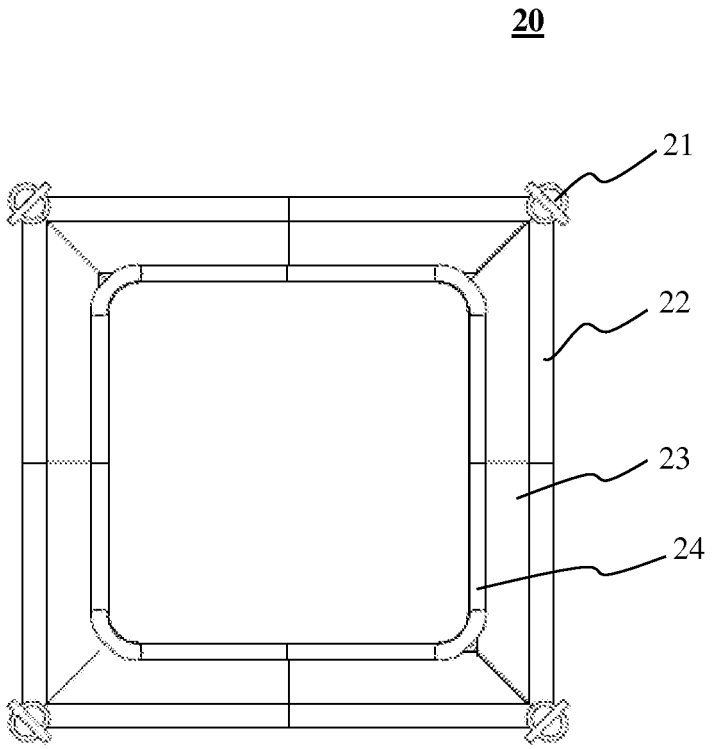
FIG. 5 shows a top view of the arctic jackup truss leg shown in FIG. 3.

Referring now to FIGS. 3-5, there are provided isometric plan, side and top views of a portion of the arctic jackup truss leg in accordance with one embodiment of the present invention. The arctic jackup truss leg 20 comprises a plurality of chords (4 shown herein) 21, an outer bracing network 22, a bridge plate network 23, and an internal bracing network 24. The outer bracing network 22 comprises a plurality of outer bracing elements that connect the plurality of chords 21 in an exemplary diagonal configuration. The bridge plate network 23 comprises a plurality of bridge plates, where each bridge plate has two opposite ends, one end being coupled to the outer bracing elements of the outer bracing network 22. The internal bracing network 24 comprises a plurality of internal bracing elements that are coupled to the other end of the bridge plates of the bridge plate network 23, thereby the outer bracing network 22, the bridge plate network 23, and the internal bracing network 24 act together as a strong integrated structure.

The number of chords in an arctic jackup truss leg can be variable; for example, 3 chords could be used in some embodiments.

The chords, bridge plates and bracing elements could be any suitable material; in certain embodiments, steel is used; for example, high strength 100 ksi steel for the chords, 50-75 ksi steel for the bridge plates and bracing elements.

The chords, bridge plates and bracing elements could be assembled in any workable manner; in certain embodiments, all metal elements are welded together.

Figure 7:
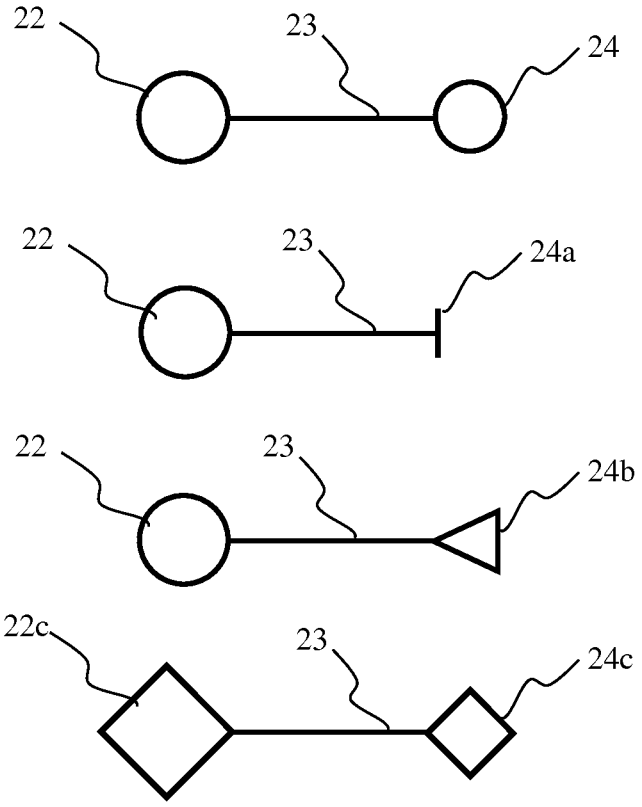
FIG. 7 shows some exemplary configurations of the bracing elements in the outer and internal bracing networks.

The cross-sectional configurations of bracing elements could be any of a range of workable shapes, for example, circular, square, triangular or simple flanges (plates); the exemplary configurations of bracing elements are shown in FIG. 7.

The sizes of the chords, bridge plates and bracing elements could be variable depending upon specific applications; in certain embodiments, the chords are larger than the bracing elements in terms of main dimension such as diameter, and the outer bracing elements in the outer bracing network are larger than the internal bracing elements of the internal bracing network in terms of main dimension such as diameter. The bridge plates need to provide some separation between the outer and internal bracing networks; in certain embodiments, the width of the bridge plates are in the range of 1 to 6 times the diameter of the bracing elements of the outer bracing network, and the thickness of the bridge plates is in the range of 10-50 mm.

The configurations of the outer and internal bracing networks could be more than diagonal or X bracing; for example, K bracing, split X bracing or reverse K bracing.

Figure 6:
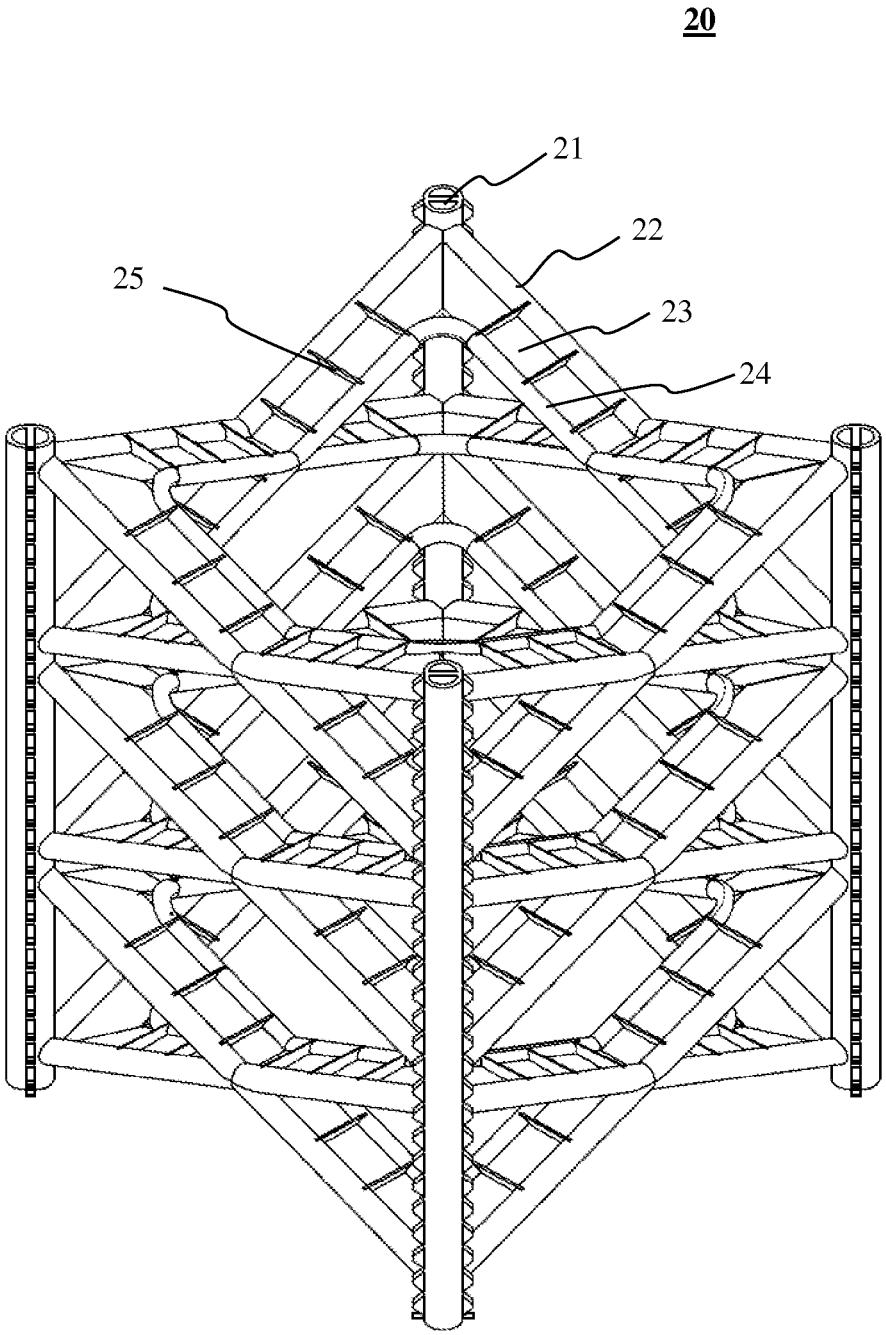
FIG. 6 shows an isometric plan view of a portion of the arctic jackup truss leg with stiffeners in accordance with another embodiment of the present invention.

In certain embodiments, additional stiffeners are added to the bridge plates in order to increase the strength and stiffness of the bridge plates. As shown in FIG. 6, the stiffeners 25 are applied to the bridge plates 23. In certain embodiments, the stiffeners are applied to one side of the bridge plate; in certain embodiments, the stiffeners are applied to both sides of the bridge plate. In addition, the bridge plates could be provided with some openings (not shown) to allow water to drain out; this could prevent water from pooling and freezing during operation.

The following example is provided for the sole purpose of illustrating the principles of the present invention; actual size could be larger or smaller depending on the overall size of the jackup rig and the design environmental condition.

Leg Member Properties:

1. 4-chorded leg

Chord-chord spacing=35 ft (10.7 m)

Bay height=16 ft (4.9 m)

Chord sizing=30 in O.D×4 in W.T (762 mm×102 mm)

Chord yield stress=100 ksi (689 Mpa)

2. The diagonal braces are configured in X-pattern (X-Braces).

brace sizing=20 in O.D×2 in WT (508 mm×51 mm)

brace yield stress=75 ksi (517 Mpa)

3. In order to increase the diagonal braces capacity, additional plates and internal braces are installed behind diagonal braces Plate depth 40 in with 1.5 in thickness (1016 mm×38 mm)

Internal brace sizing=16 in O.D×2 in WT (406 mm×51 mm)

Plate and internal braces yield stress=51 ksi (351 Mpa)

The arctic jackup truss leg could be assembled using standard construction techniques of welding of each of the steel members to each other. As an example, the diagonal braces could be welded to the chords, the bridge plates welded to the diagonal braces and finally the internal braces welded to the bridge plates. In the case of retrofit, the chord and outer brace members would be pre-existing and the bridge plate and internal braces would be welded to the existing leg structure. Alternative means of fixing such as clamping may also be used. This may be a preferred option if retrofit is to be done, as it would allow prefabrication of the bridge plate and internal bracing members, followed by clamping to the existing structures.

While the present invention has been described with reference to particular embodiments, it will be understood that the embodiments are illustrative and that the invention scope is not so limited. Alternative embodiments of the present invention will become apparent to those having ordinary skill in the art to which the present invention pertains. Such alternate embodiments are considered to be encompassed within the scope of the present invention. Accordingly, the scope of the present invention is defined by the appended claims and is supported by the foregoing description.

What is claimed is:

1. A truss leg employable in a jackup platform, said truss leg comprising:

a plurality of chords;

an outer bracing network with a plurality of outer bracing elements connecting the plurality of chords, wherein the plurality of chords are connected to the plurality of outer bracing elements at two or more locations along each of the plurality of chords an internal bracing network with a plurality of internal bracing elements, wherein the plurality of internal bracing elements of the internal bracing network are substantially in parallel with the plurality of outer bracing elements of the outer bracing network; and a bridge plate network with a plurality of bridge plates, wherein each bridge plate has two ends that are coupled with the bracing elements of the outer bracing network and the internal bracing network respectively;

thereby the outer bracing network, the bridge plate network, and the internal bracing network act together as an integrated member;

wherein the truss leg is movably coupled to a jackup platform.

2. The truss leg of claim 1, further comprising a plurality of stiffeners, wherein the plurality of stiffeners are applied to the bridge plates.

3. A jackup platform comprising:

a platform;

a plurality of arctic jackup truss legs; wherein the plurality of arctic jackup truss legs are movably coupled to the platform; and platform accessories;

wherein each of the plurality of the arctic jackup truss legs comprises:

a plurality of chords;

an outer bracing network with a plurality of outer bracing elements connecting the plurality of chords, wherein the plurality of chords are connected to the plurality of outer bracing elements at two or more locations along each of the plurality of chords an internal bracing network with a plurality of internal bracing elements, wherein the plurality of internal bracing elements of the internal bracing network are substantially in parallel with the plurality of outer bracing elements of the outer bracing network; and a bridge plate network with a plurality of bridge plates, wherein each bridge plate has two ends that are coupled with the bracing elements of the outer bracing network and the internal bracing network respectively;

thereby the outer bracing network, the bridge plate network, and the internal bracing network act together as an integrated member.

4. The jackup platform of claim 3, wherein the arctic jackup truss leg further comprises a plurality of stiffeners, wherein the plurality of stiffeners are applied to the bridge plates.

* * * * *